United States Patent [19]

Nakahama

[11] Patent Number: 5,002,809

[45] Date of Patent: Mar. 26, 1991

[54] COATING METHOD

[75] Inventor: Tadamitsu Nakahama, Hiroshima, Japan

[73] Assignee: Mazda Motor Corporation, Hiroshima, Japan

[21] Appl. No.: 359,338

[22] Filed: May 31, 1989

[30] Foreign Application Priority Data

May 31, 1988 [JP] Japan ..... 63-133815

[51] Int. Cl.[5] ..... B05D 1/36; B05D 7/00

[52] U.S. Cl. ..... 427/407.1; 427/409; 427/410

[58] Field of Search ..... 427/407.1, 409, 410

[56] References Cited

FOREIGN PATENT DOCUMENTS 57-190057 11/1982 Japan .
58-273 1/1983 Japan .
59-160572 9/1984 Japan .

*Primary Examiner*—Michael Lusignan

*Attorney, Agent, or Firm*—Fleit, Jacobson, Cohn, Price, Holman & Stern

[57] ABSTRACT

A coating method of an external surface of a vehicle body comprising steps of applying an urethane base coating material to a first area of the vehicle body to form an anti-chipping coating on the first area, applying an intercoating material including a solvent and an anti-sagging agent by spray to the the first area on which the anti-chipping coating has been formed and a second area of the vehicle body other than the first area to form an intercoating when the anti-chipping coating is in a wet condition. First intercoating material is applied to the first area to form one part of the intercoating. Second intercoating material is applied to the second area to form the other part of the intercoating. The first intercoating material is greater than the second intercoating material in an anti-sagging property so that the resultant coating has an improved smoothness and anti-chipping property.

17 Claims, 1 Drawing Sheet

COATING METHOD

BACKGROUND OF THE INVENTION

1. Field of the invention

The present invention relates to a coating method, specifically to a method for coating a vehicle body in order to form a coating resistant to a chipping.

2. Description of the Prior Art

A specific portion of an external surface of the vehicle body, for instance, a lower side portion of the vehicle body is likely to be hit and damaged by stones, sand, various agent dispersed on a road surface and the like while running resulting in a chipping of a coating. Conventionally, there has been known a method for forming an anti-chipping coating on such specific portion of the external surface as undercoating thereafter forming an intercoating and a face coating as taught by Japanese Patent Public Disclosure No. 58-273, laid open to the public on Jan. 5, 1983.

Japanese Patent Public Disclosure No. 57-190057, laid open to the public on Nov. 22, 1982, also discloses a method for making an anti-chipping coating. Japanese Patent Public Disclosure No. 59-160572, laid open to the public on Sept. 11, 1984 discloses a polyurethane base coating material as employed for an anti-chipping coating.

A vinyl chloride resin has been employed for making the anti-chipping coating. Recently, one-can type urethane (blocked polyurethane coating material) is often used as the anti-chipping coating because the vinyl chloride resin has a high viscosity which make it difficult to get a coating surface of a desirable smoothness.

The one-can type urethane coating material for the anti-chipping coating may cause an undesirable surface roughening of the resultant coating in the vicinity of a peripheral portion of an area in which the anti-chipping coating is formed. In view of the above, it has been known that a tape is applied on a potential portion of the vehicle body to prevent the coating from the surface roughening wherein the tape is removed after the anti-chipping coating for enabling an intercoating step.

It will however be understood that this method is disadvantageous in efficiency because the number of steps is increased.

There has been proposed so called wet-on-wet method for forming an anti-chipping coating without using tape in which an intercoating step is carried out before the anti-chipping coating is dried up.

This method is advantageous in the point that the anti-chipping coating material is draped with the intercoating material to eliminate the problem of the surface roughening without using any tape.

It should however be noted that the wet-on-wet method is disadvantageous in the following point. Namely, a solvent of the undercoating material or anti-chipping coating material is dispersed into the intercoating material to lower a viscosity of the intercoating material thereby causing a sagging of the coating to deteriorate an appearance of the coating.

In order to eliminate the problem, it may be effective to reduce a thickness of the anti-chipping coating. This causes a different problem in which a chipping resistance property is undesirably lowered.

SUMMARY OF THE INVENTION

It is therefore an object of the invention to provide a coating method for a vehicle body which can improve an chipping resistance property without increasing the number of steps. It is another object of the invention to provide a coating method which can provide a sufficient smoothness of a coating surface.

According to the present invention, the above and other objects can be accomplished by a coating method of an external surface of a vehicle body comprising steps of applying an urethane base coating material to a first area of the vehicle body to form an anti-chipping coating on the first area, applying an intercoating material including a solvent and an anti-sagging agent by applicator means to the first area on which the anti-chipping coating has been formed and a second area of the vehicle body other than the first area to form an intercoating when the anti-chipping coating is in a wet condition wherein the improvement further comprises steps of applying a first intercoating material to the first area to form one part of the intercoating, applying a second intercoating material to the second area to form the other part of the intercoating, the first intercoating material being greater than the second intercoating material in an anti-sagging property.

The urethane base coating material can be constituted by one-can urethane coating material. Typically, the urethane coating material comprises 25 parts by weight of urethane resin, 8 parts of epoxy resin, 37 parts of calcium carbonate (as a pigment), 3 part of carbon black (as pigment), 30 parts of butyl acetate (as solvent) and 17 parts of cellosolve acetate (as solvent). This urethane base coating material includes 73 wt % of nonvolatile content and has a viscosity of 3200 cP. Preferably, a thickness of the anti-chipping coating is more than approximately 100 $\mu$m.

According to the present invention, the anti-sagging property of the first the intercoating material applied on anti-chipping coating in a wet-on-wet relationship is greater than the second intercoating material so that a sagging of the intercoating can be prevented to get a desirable smoothness of the resultant coating surface.

In order to increase the anti-sagging property, more anti-sagging agent may be added to the first intercoating material. Alternatively, a viscosity of the first intercoating material can be increased for preventing the sagging. Both the anti-sagging agent and the viscosity of the first intercoating material can be increased for the above purpose. Any anti-sagging agent commonly used, such as crosslinked acrylic resin powder, organic bentonite can be employed for the present invention. In the case where the first intercoating material is increased in viscosity in order to get the anti-sagging property, the same kind coating material as the second intercoating material can be used for the first intercoating material. In this case, the viscosity of the material is adjusted for the first intercoating. Different materials can be employed for the first and second intercoatings having suitable viscosity respectively.

Any kind of intercoating material available for a coating of the vehicle body such as thermoplastic type epoxy modified oil free polyester resin coating material can be employed.

Typically, the intercoating material as base compound comprises 22 parts by weight of oil free polyester resin, 8.4 parts of melamine resin, 2 parts of epoxy resin, 2.6 part of anti-sagging agent, 16.5 parts of titanium white (as pigment), 0.5 parts of carbon black (as pigment), 22 parts of triol (as solvent), 15 parts of solvesso #100 (as solvent) and 11 parts of solvesso #150. The intercoating material includes 52 wt % of nonvolatile components and has a viscosity of 24 second measured by Ford cup #4 defined by ASTM D-1200.

The solvent is preferably included more than approximately 30 wt % of the total weight of the intercoating material. The viscosity according to Ford cup #4 in the case of this minimum value of the solvent is approximately 45 second. Preferably, the viscosity of the first intercoating material is more than approximately 27 second. The maximum value of the anti-sagging agent is approximately 15 wt % of the nonvolatile content. This is because the more anti-sagging agent affects the glossiness of the resultant coating. Preferably the anti-sagging agent is included approximately more than 5 wt % of the nonvolatile content.

After the first and second intercoating materials are applied and fixed on the undercoating, an overcoating or face coating is applied thereon. As for a facing coating material known available for the facing paint, any kind material such as thermoplastic type melamine alkyd resin paint can be employed for the present invention.

Typically, the face coating material as base compound for a white color comprises 32 parts by weight of alkyd melamine resin, 15 parts of titanium white (as pigment), 0.01 parts of carbon black (as pigment), 1.5 parts of anti-sagging agent, 24 parts of triol (as solvent), 16 parts of solvesso #100(as solvent) and 12 parts of solvesso #150. The intercoating material includes 52 wt % of nonvolatile components and has a viscosity of 24 second measured by Ford cup #4 defined by ASTM D-1200.

The above and other objects and features of the present invention can be understood based on the following description taking reference with the accompanying drawings.

DESCRIPTION OF THE PREFERRED EMBODIMENT

Figure 1:
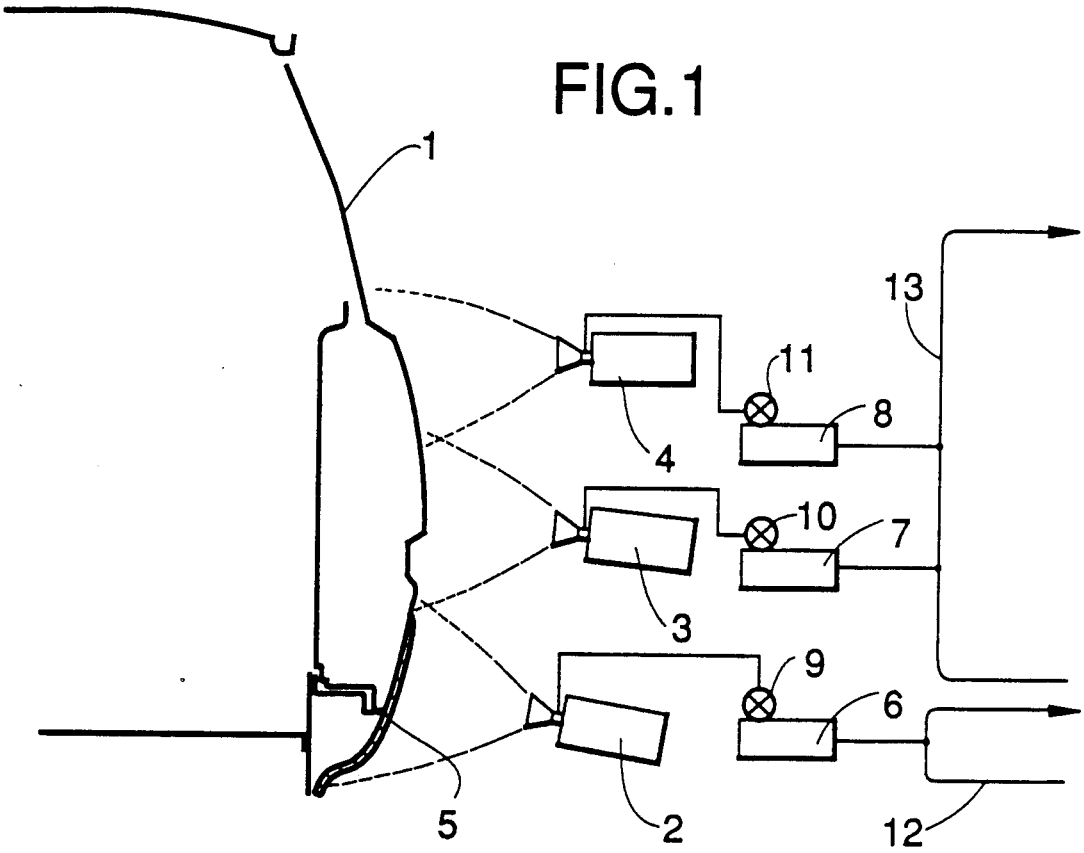
FIG. 1 is a schematic view of a coating device for coating an external surface of a vehicle body in accordance with the present invention.

Referring to the drawings, specifically to FIG. 1, a work 1 constituting a part of an external surface of a vehicle body is subjected to an anti-chipping coating step. In this step, an one-can urethane paint is applied to a lower side portion of the work 1 to form an anti-chipping coating 5. The work 1 is transferred to an intercoating section before the anti-chipping coating is dried up. In the intercoating section, the work 1 is positioned at a position facing to a first, second and third rotary spray coating devices 2, 3 and 4. An intercoating material is sprayed on specific areas of the work 1 from the respective coating devices 2, 3 and 4. In this step, the coating device 2 applies the intercoating material to the anti-chipping coating 5 in a wet-on-wet relationship. There are provided control valves for controlling the intercoating material from pumps 9, 10 and 11 connected with circulation passages 12 and 13 (the pump 9 is connected with the circulation passage 12 and the pumps 10 and 11 with the circulation passage 13.) In the circulation passage 12 is circulated a first intercoating material of a relatively high anti-sagging property. On the contrary, a second intercoating material of a relatively low anti-sagging property is circulated in the circulation passage 13.

Figure 2:
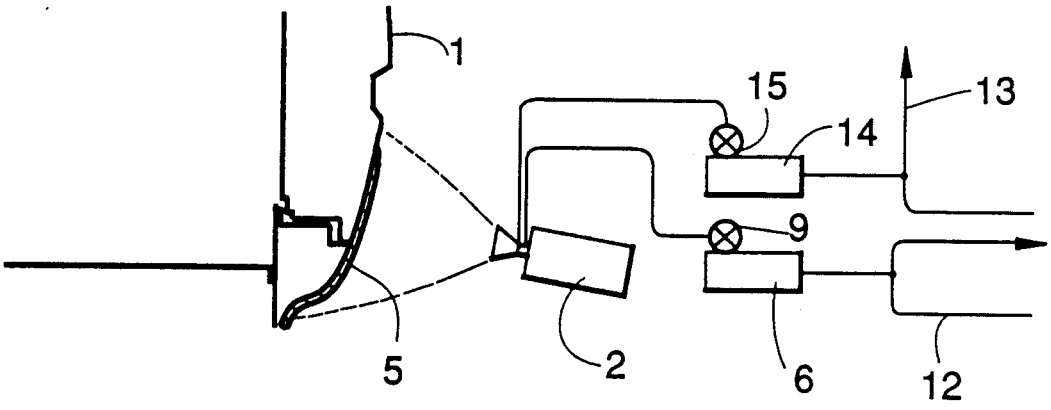
FIG. 2 is a schematic view of a coating device similar to FIG. 1 but showing another embodiment of the present invention.

Referring to FIG. 2, there is shown a coating device in accordance with another embodiment of the present invention.

In this embodiment, there is further provided a valve 15 connected with the first rotary spray device 2 for controlling the second intercoating material from a pump 15 so as to adjust the anti-sagging property of the first intercoating material sprayed from the first rotary spray device 2.

EXAMPLE

An one-can urethane paint was applied to a side sill portion and a lower portion of a front door in a vehicle body by an airless pump having a compression ratio of 30:1 with a nozzle tip 163–419 (pattern width; 20 cm, diameter of the nozzle; 19/1000 in), a primary air pressure; 4.5 kg/cm2. The urethane coating material comprises 25 parts by weight of urethane resin, 8 parts of epoxy resin, 37 parts of calcium carbonate (as a pigment), 3 part of carbon black (as pigment), 30 parts of butyl acetate (as solvent) and 17 parts of cellosolve acetate (as solvent). This urethane base coating material includes 70 wt % of nonvolatile content with 3200 cP of viscosity(measured by a B type viscosimeter defined by ASTM D-2983 at a condition of 60 rpm, 20 centigrade in temperature) and is supplied by a delivery rate; 1200 cc/min to form a coating of a thickness at a dried condition shown in Table 1.

TABLE 1

| Sample | Thickness(μm) | 1st intercoat | 2nd intercoat |
|---|---|---|---|
| # 1 | 70(comparative) | Base | Base |
| 2 | 100(comparative) | Base | |
| 3 | 150(comparative) | Base | |
| 4 | 150(comparative) | Compound 1 | Compound 1 |
| 5 | 100 | Compound 1 | Base |
| 6 | 100 | Compound 2 | Base |
| 7 | 150 | Compound 1 | Base |
| 8 | 150 | Compound 2 | Base |
| 9 | 150 | Compound 3A, 3B | Base |
| 10 | 150 | Compound 4A, 4B | Base |
| # 11 | 100 | Compound 5 | Base |
| 12 | 100 | Compound 6 | Base |
| 13 | 150 | Compound 6 | Base |
| 14 | 100 | Compound 7 | Base |
| 15 | 150 | Compound 7 | Base |
| 16 | 100 | Compound 8 | Base |
| 17 | 150 | Compound 8 | Base |
| 18 | 100 | Compound 9 | Base |
| # 19 | 100 | Compound 10 | Base |
| 20 | 100 | Compound 11 | Base |
| 21 | 150 | Compound 11 | Base |
| 22 | 100 | Compound 12 | Base |
| 23 | 150 | Compound 12 | Base |

2 minutes after the application of the one-can urethane paint, the intercoating step was carried out before the urethane coating is in a wet condition.

The intercoating process is applied for samples #1 through #8 shown in Table 1 through the coating device of FIG. 1 and through the device of FIG. 2 for samples 9 and 10 in Table 1. Compositions and properties of intercoating materials employed in this test are described in Table 1. The intercoating material as base compound comprises 22.0 parts by weight of oil free polyester resin, 8.4 parts of melamine resin, 2.0 parts of epoxy resin, 2.6 part of anti-sagging agent, 16.5 parts of titanium white (as pigment), 0.5 parts of carbon black (as pigment), 22.0 part of triol (as solvent), 15.0 parts of solvesso #100(as solvent) and 11.0 parts of solvesso #150. The base intercoating material includes 52 wt % of nonvolatile components and has a viscosity of 24 second measured by Ford-Cup #4 defined by ASTM D-1200. A condition of the rotary as follows:

| | |
|---|---|
| bell diameter; | 60 mm |
| rotation speed of bell hub; | 22,000 rpm |
| shaping air pressure; | 3.0 kg/cm2 |
| applied voltage; | −90 kV |
| distance between device and work; | 30 cm |

A thermoplastic type epoxy modified oil free polyester resin paint is employed as the intercoating material. The compositions and the properties thereof are shown in Table 2.

TABLE 2

| Intercoat kind | Nonvolatile content(%) | Viscosity (sec) | Anti-sag agent(%) | supply (cc/min) |
|---|---|---|---|---|
| Base | 52 | 24 | 5 | 200 |
| Compound 1 | 63 | 35 | 5 | 200 |
| Compound 2 | 55.5 | 24 | 15 | 200 |
| Compound 3A | 52 | 24 | 5 | 100 (base) |
| Compound 3B | 68 | 40 | 5 | 100 |
| Compound 4A | 52 | 24 | 5 | 150 (base) |
| Compound 4B | 54 | 24 | 12 | 50 |
| Compound 5 | 55 | 27 | 4.73 | 190 |
| Compound 6 | 58 | 32 | 4.48 | 178 |
| Compound 7 | 61 | 35 | 4.26 | 160 |
| Compound 8 | 64 | 39 | 4.02 | 155 |
| Compound 9 | 52 | 24 | 7 | 200 |
| Compound 10 | 52 | 24 | 9 | 200 |
| Compound 11 | 52 | 24 | 11 | 200 |
| Compound 12 | 52 | 24 | 13 | 200 |

In Table 2, the viscosity of the materials was measured by Ford-Cup #4 defined by ASTM D-1200 at a temperature of 20 centigrade degree. A crosslinked acrylic resin powder was added to the material as an anti-sagging agent. Nonvolatile component is provided as wt % against a total weight of the intercoating material. The anti-sagging agent is provided as wt % against a weight of the nonvolatile content.

After the intercoating process, the work 1 was positioned for drying and stoving process in 10 minutes. Thereafter, the drying and stoving process were carried out for 25 minutes at 140 degree centigrade.

There is shown in Table 3 a test result based on viewing with regard to a sagging of the intercoating formed by means of the first spray coating device 2 by visually measuring length of the sagging.

In next, an overcoating or face coating material comprising a thermoplastic type melamine alkyd resin were applied to the work 1 over the intercoating to form a coating thickness of 40 μm. The face coating material as base compound for a white color comprises 32.0 parts by weight of alkyd melamine resin, 15.0 parts of titanium white (as pigment), 0.01 parts of carbon black (as pigment), 1.5 part of anti-sagging agent, 24.0 part of triol (as solvent), 16 parts of solvesso #100(as solvent) and 12 parts of solvesso #150. The intercoating material includes 52 wt % of nonvolatile components and has a viscosity of 24 second measured by Ford cup #4 defined by ASTM D-1200.

After the face coating process, the work 1 was positioned for drying and stoving process in 10 minutes. Thereafter, the drying and stoving process were carried out for 25 minutes at 140 degree-centigrade.

The resulting coating was subjected to a smoothness test by measuring PGC value utilizing PGC glossmeter. The test result is shown in Table 3.

TABLE 3

| Sample | Sag-Length(mm) | Glossiness(PGD value) 1st intercoat | 2nd intercoat |
|---|---|---|---|
| # 1 | less than 1 | 0.4 | 0.6 |
| 2 | 4–6 | 0.4 | 0.6 |
| 3 | 30–50 | 0.4 | 0.6 |
| 4 | null | 0.3 | 0.4 |
| 5 | null | 0.3 | 0.6 |
| 6 | null | 0.3 | 0.6 |
| 7 | null | 0.3 | 0.6 |
| 8 | null | 0.3 | 0.6 |
| 9 | less than 1 | 0.3 | 0.6 |
| 10 | null | 0.3 | 0.6 |
| # 11 | 2–3 | 0.4 | 0.6 |
| 12 | null | 0.3 | 0.6 |
| 13 | 2–3 | 0.4 | 0.6 |
| 14 | null | 0.3 | 0.6 |
| 15 | 1–2 | 0.3 | 0.6 |
| 16 | null | 0.2 | 0.6 |
| 17 | null | 0.3 | 0.6 |
| 18 | 3–4 | 0.4 | 0.6 |
| # 19 | null | 0.4 | 0.6 |
| 20 | null | 0.4 | 0.6 |
| 21 | 3–4 | 0.4 | 0.6 |
| 22 | null | 0.4 | 0.6 |
| 23 | 1–2 | 0.4 | 0.6 |

The intercoating material applied to the first area has the same composition as that applied to the second area of the work 1 in the samples #1 through #3 in accordance with prior art.

The sample #1 having an one-can urethane coating of 70 μm in thickness is insufficient in the anti-chipping property because the urethane coating is too thin, although sagging thereof is small or PGD value is large. The samples #2 and #3 are disadvantageous in that sagging thereof in the intercoating are remarkable. This deteriorates the appearance of the resultant coating. Specifically, the sample #3 coating having a thickness of 150 μm enough to prevent a chipping shows a remarkable sagging.

In the sample #4, the intercoating was made in a manner that a first intercoating material having a more anti-sagging property than usual was applied to both the first area on which the one-can urethane coating is formed as the anti-chipping coating and the second area other than the first area of the external surface of the work. There is no sagging in the sample #4. It was however found that a smoothness of the coating was deteriorated in the second area.

Generally, the first area is located at lower portion of the vehicle so that the smoothness of the coating is not a big problem. On the other hand, the second area is located at upper portion of the vehicle so that viewer is easy to find a roughness of the coating and thus might be a big problem.

In the samples #5 through #10, the intercoating were made in a manner that the first intercoating material having more anti-sagging property than usual was applied to the first area on the one-can urethane coating in a wet-on-wet relationship and the second intercoating material of an usual anti-sagging property was applied to the second area. There were found no sagging or only a slight sagging on the samples. It was found that they have fine smoothness of the resultant coating in comparison with the samples #1 through #4. This is true with regard to not only the samples #5 and #6 having a urethane coating thickness of 100 μm but also the samples #7 through #10 having a urethane coating thickness of 150 μm.

There is no substantial difference between the samples #5 through #8 obtained through the coating device of FIG. 1 and the samples #9 and #10 obtained through the coating device of FIG. 2.

In the samples #18–#23, the amount of the anti-sagging agent is held constant and the solvent is changed for the first intercoating material. On the other hand, in the samples #11–#17, the solvent is held substantially constant and the anti-sagging agent is changed.

In view of the above result, the solvent is preferably included more than approximately 30 wt % of the total weight of the intercoating material. The viscosity according to Ford cup #4 in the case of this minimum value of the solvent is approximately 45 second. A minimum value of the viscosity of the first intercoating material is considered approximately 27 second. The amount of the anti-sagging agent included in the first intercoating material is preferably ranged from approximately 4 wt % to 15 wt % of the nonvolatile content. The maximum value of the anti-sagging agent is approximately 15 wt % of the nonvolatile content. This is because more than 15 wt % anti-sagging agent affects the glossiness of the resultant coating.

It will be apparent from the above description that many modifications and variations may be made by those skilled in the art without departing from the scope of the claimed invention as

I claim:

1. A coating method of an external surface of a vehicle body comprising steps of:

(a) applying an anti-chipping coating material having an urethane base coating material and a solvent on a first area of a vehicle body where an anti-chipping coating is desired so that an anti-chipping coating is formed on the first area;

(b) applying a first intercoating material having an anti-sagging property on the first area when the anti-chipping coating is in a wet condition; and (c) applying a second intercoating material having an anti-sagging property on a second area of the vehicle body other than the first area when the anti-chipping coating is in the wet condition, wherein the first intercoating material is greater than the second intercoating material in the anti-sagging property.

2. A coating method in accordance with claim 1 wherein the first intercoating material is greater than the second intercoating material in viscosity.

3. A coating method in accordance with claim 2 wherein the first intercoating material includes less solvent than the second intercoating material.

4. A coating method in accordance with claim 1 wherein the first intercoating material includes more anti-sagging agent than the second intercoating material.

5. A coating method in accordance with claim 4 wherein the anti-sagging agent comprises a crosslinked acrylic resin powder.

6. A coating method in accordance with claim 1 wherein the first intercoating material is applied to the first area by utilizing first spray means, the second intercoating material being applied to the second area by utilizing second spray means independent from the first spray means.

7. A coating method in accordance with claim 6 wherein the first intercoating material is supplied to the first spray means through first passage means, the second intercoating material being supplied to the second spray means through second passage means independent from the first passage means.

8. A coating method in accordance with claim 6 wherein the second intercoating material is supplied to the first spray means in addition to the first intercoating material to be intermingled with each other and thereafter applied to the first area.

9. A coating method in accordance with claim 8 wherein the first intercoating material is greater than the second intercoating material in viscosity.

10. A coating method in accordance with claim 9 wherein the first intercoating material includes less solvent than the second intercoating material.

11. A coating method in accordance with claim 10 wherein the first intercoating material includes more anti-sagging agent than the second intercoating material.

12. A coating method in accordance with claim 1 wherein the first intercoating material is greater in viscosity and includes more anti-sagging agent than the second intercoating material.

13. A coating method in accordance with claim 12 wherein the first intercoating material includes less solvent than the second intercoating material.

14. A coating method in accordance with claim 8 wherein the first intercoating material is greater in viscosity and includes more anti-sagging agent than the second intercoating material.

15. A coating method in accordance with claim 14 wherein the first intercoating material includes less solvent than the second intercoating material.

16. A coating method in accordance with claim 1 wherein the improvement further comprises a step of applying an overcoating material to the first and second area after applying the first and second intercoating materials thereto.

17. A coating method in accordance with claim 1 wherein the urethane base coating material is an one-can urethane paint.

* * * * *